United States Patent [19]

McQuiggin

[11] Patent Number: 4,616,430

[45] Date of Patent: Oct. 14, 1986

[54] METHOD OF MAKING AN ARTICLE OF FOOTWEAR

[75] Inventor: John McQuiggin, Boreham Wood, Great Britain

[73] Assignee: E.T.F. Enterprises, Inc., New York, N.Y.

[21] Appl. No.: 623,922

[22] Filed: Jun. 25, 1984

[30] Foreign Application Priority Data

Dec. 23, 1983 [GB] United Kingdom ..... 8334445

[51] Int. Cl.[4] ..... A43C 13/08

[52] U.S. Cl. ..... 36/14; 12/146 BR; 12/146 M; 264/244

[58] Field of Search ..... 36/14; 264/244; 12/146 M, 146 BR

[56] References Cited

U.S. PATENT DOCUMENTS

| | | | |
|---|---|---|---|
| 3,345,664 | 10/1967 | Ludwig | 264/244 |
| 3,504,079 | 3/1970 | Hall | 264/244 |
| 3,671,621 | 6/1972 | Fukuoka | 264/244 |
| 3,676,542 | 7/1972 | Maltby | 264/244 |
| 4,276,254 | 6/1981 | Combronde | 264/244 |
| 4,407,034 | 10/1983 | Ralphs | 36/14 |

FOREIGN PATENT DOCUMENTS

| | | | |
|---|---|---|---|
| 1520049 | 8/1978 | United Kingdom | 264/244 |

*Primary Examiner*—Werner H. Schroeder
*Assistant Examiner*—Mary A. Ellis
*Attorney, Agent, or Firm*—Gottlieb, Rackman & Reisman

[57] ABSTRACT

An article of footwear is made by partially forming the article so as to comprise at least an upper (11) lasted to a first insole (12), arranging the partially formed article to fully expose the upper (or inner) surface of the first insole, preferably by turning the partially formed article inside out, and moulding a shock absorbing or resilient second insole (15) of elastomeric, preferably visco-elastic, material onto the exposed surface of the lasting insole. An outsole (13) is applied to the article at some stage, preferably before the second insole is moulded in.

22 Claims, 3 Drawing Figures

METHOD OF MAKING AN ARTICLE OF FOOTWEAR

DESCRIPTION

This invention relates to a method of making an article of footwear, particularly a dimensionally stable article of footwear such as a shoe, and to an article of footwear.

The invention provides in a first embodiment a method of making an article of footwear, comprising the steps of:

(a) partially forming the article so as to comprise at least an upper lasted to a first insole, (b) arranging the partially formed article to fully expose the upper surface of the first insole, and (c) moulding a second insole of elastomeric material onto the exposed surface of the first insole;

an outsole being applied to the article at some stage.

In general, the article of footwear made in accordance with this invention is formed by partially turning the article inside out, and preferably applying the outsole portion prior to turning the article inside out and also before moulding the second insole onto the exposed surface of the insole. The second insole, preferable of a visco-elastic material, is introduced by pouring a liquid composition into a mould cavity which is closed by the exposed surface of the insole. The mouldable composition is both introduced into and maintained in the mould cavity at an elevated temperature, and a cover of suitable flexible material is applied to the second insole while it is still in a "tacky" condition. The mould cavity utilized provides an appropriate anatomic shape to the principal surface of the second insole.

The invention provides in a second embodiment an article of footwear, preferably a dimensionally stable article of footwear such as a shoe, made by a method according to the first embodiment of the invention.

The invention provides in a third embodiment an article of footwear comprising an upper, a first insole lasted to the upper, an outsole, and a resilient or shock absorbing second insole moulded directly to the upper surface of the first insole.

The term "visco-elastic," as used hereinafter, means a material which is elastic in that it returns to its original shape after distortion, and which is viscous in that returns to its original shape more slowly than rubber, or in other words it creeps rather than springs back to its original shape. Suitable visco-elastic materials include, for example, cross-linked polyurethane elastomers containing a particulate filler (which may itself be elastomeric) not linked to the polymeric chains of the polyurethane elastomer. Such elastomers are commonly formed from a prepolymer composition comprising a polyol component and a polyisocyanate component, for example the polyol "Polyol Hyperlast" 2851/229 and the polyisocyanate "Isocyanate" 2875/000, both sold by B+T Polymers Limited of Stockport, Cheshire, England.

The invention will now be more particularly described, by way of example, with reference to the accompanying drawings, in which.

Figure 1:
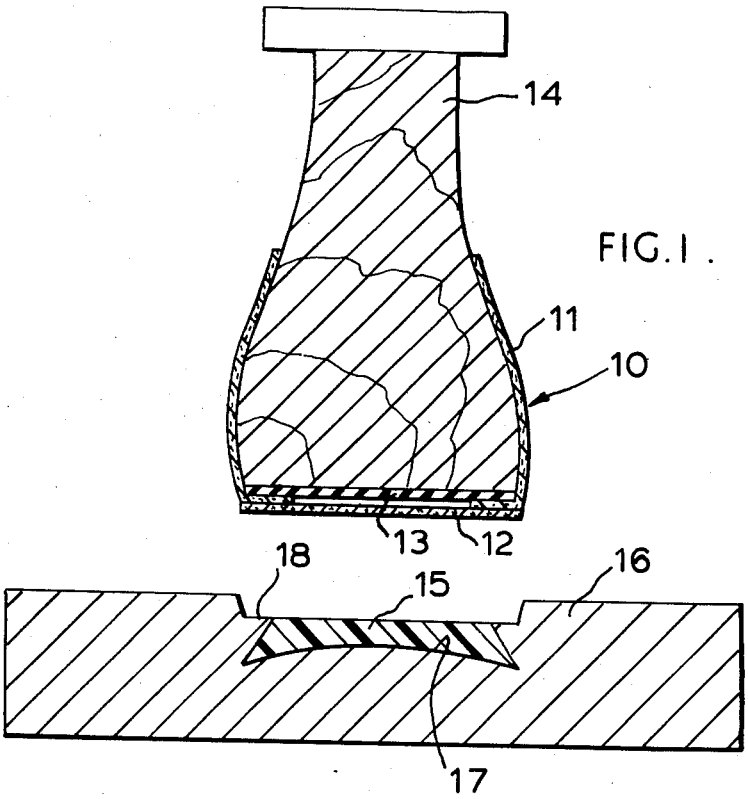
FIG. 1 is a sectional view of a partially formed shoe turned inside out and mounted on a moulding last and an insole mould containing a liquid mouldable composition, prior to closure of the mould.
Figure 2:
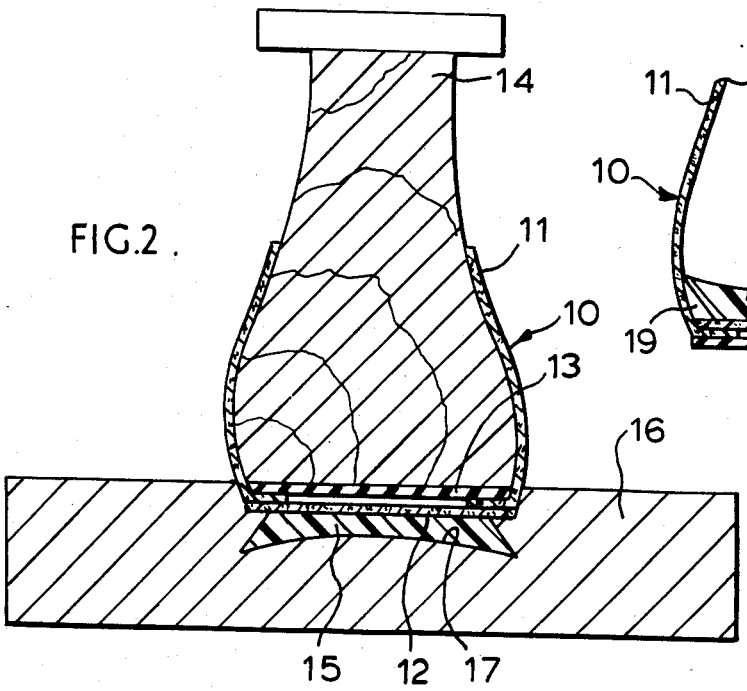
FIG. 2 is a sectional view showing the mould of FIG. 1, after closure.

Referring now to the drawings, a shoe 10 is partially formed so as to comprise an upper 11, a lasting insole 12 and an outsole 13. The partially formed shoe is then turned inside out, whereby the upper (or inner) surface of the lasting insole is exposed, and mounted on a moulding last 14. The partially formed shoe is made in conventional manner by lasting the upper 11 to the lasting insole 12 such as by using a "Kamborian" type of lasting machine and hot melt adhesive (e.g. a hot melt polyamide adhesive), roughing the lasting margin and bonding an outsole to the roughed lasting margin using an adhesive such as elastomer solution or emulsion adhesive.

The moulding last 14 may be of plastics material, wood or aluminium.

A shock absorbing or resilient insole 15 (hereinafter simply referred to as a shock absorbing insole) of elastomeric, preferably visco-elastic, material is then moulded directly onto the lasting insole 12. This is achieved using an insole mould 16 having therein a mould cavity 17 shaped to conform with the desired shape of the shock absorbing insole 15. The mould 16 may be of epoxy resin with an aluminum filling, or of aluminium. The mould cavity 17 is filled, such as by casting or injection, with a mouldable liquid composition which is to form the shock absorbing insole 15. The mouldable liquid composition may be, for example, a liquid polyurethane prepolymer composition. The mouldable composition is introduced into the cavity 17 at an elevated temperature, e.g., at a temperature of about 35° C. and is preferably maintained at substantially this temperature whilst in the cavity 17. Because an exothermic reaction takes place in the cavity 17, it may be necessary to either heat or cool the mould 16 in order to maintain the composition in the cavity 17 at the desired temperature, depending on the ambient temperature, the material of the mould and liquid mouldable composition used. This can be achieved by circulating water through passages or tubes in an aluminium plate (not shown) in contact with the lower surface of the mould 16.

After slight gellification of the composition, e.g., after about 20 seconds, the moulding last 14 and partially formed shoe are brought down onto a ledge 18 surrounding the mould cavity 17 and pressure, e.g. at about 30 bars, is applied to the moulding last to hold the exposed surface of the insole 12 in contact with the mouldable composition in the cavity 17. After the composition has had time to reach near cure status, which may occur within about 4 minutes, the mould is opened by raising the moulding last 14, and the shock absorbing insole 15, which has been formed from the mouldable composition and which is now securely attached to the lasting insole 12, is drawn out of the mould cavity 17. The shoe can then be turned right way out and the shock absorbing insole 15 left to fully cure. This may take about 24 hours.

A cover or so-called sock (not shown) is preferably attached to the major surface of the shock absorbing insole 15 remote from the lasting insole 12. Advantageously, this is done whilst the shock absorbing insole 15 is still slightly tacky by opening the mould just before normal de-mould time, placing the cover against the shock absorbing insole 15 and wiping the cover on to the insole 15 using a piece of cloth or foam rubber.

Alternatively, the cover could be bonded to the insole 15 with an adhesive either before or after the shoe is turned right ay out. The cover may be formed of a woven or non-woven fabric along or laminated to a layer of cellular plastics material.

Figure 3:
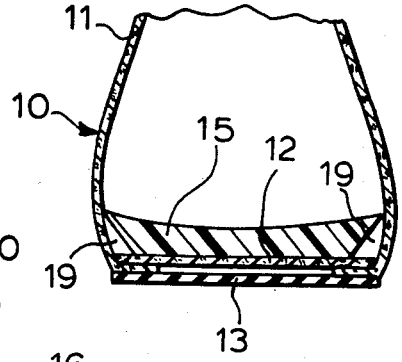
FIG. 3 is a sectional view of the finished shoe.

The upper surface of the insole 15 is given an anatomic, three dimensional, shape by giving the base of the mould cavity 17 a complementary shape. Moreover, the sides of the mould cavity are undercut so as to give the insole 15 a flared marginal portion which, as shown in FIG. 3, provides a void 19 between the upper 11 and the insole 15 into which the insole can deflect in use.

Preferably, the depth of the mould cavity decreases along its longitudinal extent from the end which defines the heel portion of the shoe, although it could be of uniform depth, and the depth of the mould cavity is such as to preferably result in the heel portion of the insole 15 having a minimum thickness of 3 mm in order to provide good shock absorbing characteristics.

The method according to the invention can be used to make any article of footwear which has an upper, a lasting insole and an outsole, provided that the upper surface of the lasting insole can be fully exposed. Normally this is achieved by turning a partially formed article inside out, but it could, for example, also be achieved by opening up an article of footwear having a first lace in the vamp of the shoe and a second lace in the counter (or rear) region of the shoe.

The method according to the invention is particularly applicable to the manufacture of dance or aerobics shoes, tennis shoes and shoes of the type commonly known as joggers or trainers, but it can also be used to make conventional shoes.

In a specific example, an aerobics shoe has a lasting insole of impregnated non-woven material such as a split leather and an outsole of high silica blown rubber (for outdoor use) or of split suede (for indoor use).

In the above described method, the mould is filled before it is closed. However, the mould could be closed and then filled, by injection, with the mouldable liquid composition.

Moreover, the outsole 13 could be applied to the article after moulding the shock absorbing insole 15 to the lasting insole 12.

I claim:

1. A method of making an article of footwear, comprising the steps of:

(a) partially forming the article so as to comprise at least an upper lasted to a first insole;

(b) arranging the partially formed article to fully expose the upper surface of the first insole by turning the partially formed article inside out;

(c) moulding a second insole of elastomeric material onto the exposed surface of the first insole; and (d) applying an outsole to the article.

2. The method of claim 1, wherein the outsole of step (d) is applied before steps (b) and (c).

3. The method of claim 1, wherein the second insole is of visco-elastic material.

4. The method of claim 1, wherein the thickness of the second insole is at least 3 mm in a heel portion of the article.

5. The method of claim 1, wherein the outsole of step (d) is applied before steps (b) and (c), wherein the second insole is of visco-elastic material and wherein the thickness of the second insole is at least 3 mm in a heel portion of the article.

6. The method of claim 1 wherein step (c) comprises introducing a mouldable liquid composition for forming the elastomeric material into a mould cavity which is closed by the exposed surface of the lasting insole.

7. The method of claim 1, wherein the outsole of step (d) is applied before steps (b) and (c), wherein the second insole is of visco-elastic material, wherein the thickness of the second insole is at least 3 mm in a heel portion of the article, and wherein step (c) comprises introducing a mouldable liquid composition for forming the elastomeric material into a mould cavity which is closed by the exposed surface of the lasting insole.

8. The method of claim 1 wherein step (c) comprises introducing a mouldable liquid composition for forming the elastomeric material into a mould cavity which is closed by the exposed surface of the lasting insole, and wherein the mould cavity has a base and undercut sides.

9. The method of claim 1, wherein step (c) comprises introducing a mouldable liquid composition for forming the elastomeric material into a mould cavity which is closed by the exposed surface of the lasting insole, wherein the mould cavity has a base and undercut sides, and wherein a base of the mould cavity is arranged so that the major surface of the second insole remote from the first insole is given an anatomic shape.

10. The method of claim 1, wherein step (c) comprises introducing a mouldable liquid composition for forming the elastomeric material into a mould cavity which is closed by the exposed surface of the lasting insole, and wherein the mouldable liquid composition is introduced into the mould cavity at an elevated temperature.

11. The method of claim 1, wherein step (c) comprises introducing a mouldable liquid composition for forming the elastomeric material into a mould cavity which is closed by the exposed surface of the lasting insole, and wherein the mouldable composition is maintained at an elevated temperature whilst in the mould cavity.

12. An article of footwear made by a method as set forth in claim 1.

13. An article of footwear in accordance with claim 12, wherein the second insole is of visco-elastic material.

14. An article of footwear in accordance with claim 12, wherein the outsole of step (d) is applied before steps (b) and (c).

15. An article of footwear in accordance with claim 12, wherein the thickness of the second insole is at least 3 mm in a heel portion of the article.

16. An article of footwear in accordance with claim 12, wherein the outsole of step (d) is applied before steps (b) and (c), wherein the second insole is of visco-elastic material and wherein the thickness of the second insole is at least 3 mm in a heel portion of the article.

17. An article of footwear in accordance with claim 12, wherein step (c) comprises introducing a mouldable liquid composition for forming the elastomeric material into a mould cavity which is closed by the exposed surface of the lasting insole.

18. An article of footwear in accordance with claim 12, wherein the outsole of step (d) is applied before steps (b) and (c), wherein the second insole is of visco-elastic material, wherein the thickness of the second insole is at least 3 mm in a heel portion of the article, and wherein step (c) comprises introducing a mouldable liquid composition for forming the elastomeric material into a mould cavity which is closed by the exposed surface of the lasting insole.

19. An article of footwear in accordance with claim 12, wherein step (c) comprises introducing a mouldable liquid composition for forming the elastomeric material into a mould cavity which is closed by the exposed surface of the lasting insole, and wherein the mould cavity has a base and undercut sides.

20. An article of footwear in accordance with claim 12, wherein step (c) comprises introducing a mouldable liquid composition for forming the elastomeric material into a mould cavity which is closed by the exposed surface of the lasting insole, wherein the mould cavity has a base and undercut sides, and wherein a base of the mould cavity is arranged so that the major surface of the second insole remote from the first insole is given an anatomic shape.

21. An article of footwear in accordance with claim 12, wherein step (c) comprises introducing a mouldable liquid composition for forming the elastomeric material into a mould cavity which is closed by the exposed surface of the lasting insole, and wherein the mouldable liquid composition is introduced into the mould cavity at an elevated temperature.

22. An article of footwear in accordance with claim 12, wherein step (c) comprises introducing a mouldable liquid composition for forming the elastomeric material into a mould cavity which is closed by the exposed surface of the lasting insole, and wherein the mouldable composition is maintained at an elevated temperature whilst in the mould cavity.

* * * * *